US006422228B1

(12) United States Patent
Latham

(10) Patent No.: US 6,422,228 B1
(45) Date of Patent: Jul. 23, 2002

(54) PORTABLE SAW ENCLOSURE APPARATUS

(75) Inventor: Winchester E. Latham, Avon, IN (US)

(73) Assignee: Keystone Engineering & Manufacturing Corporation, Avon, IN (US)

( * ) Notice: Subject to any disclaimer, the term of this patent is extended or adjusted under 35 U.S.C. 154(b) by 0 days.

(21) Appl. No.: 09/751,244

(22) Filed: Dec. 29, 2000

(51) Int. Cl.[7] ..... B28D 1/04
(52) U.S. Cl. ..... 125/13.01; 125/12; 125/14
(58) Field of Search ..... 125/12, 13.01, 125/13.03, 14, 35; 451/411, 451, 453, 414

(56) References Cited

U.S. PATENT DOCUMENTS 232,000 A * 9/1880 Clogston
283,546 A * 8/1883 Weston
4,054,179 A 10/1977 Destree
4,236,356 A 12/1980 Ward
4,308,852 A 1/1982 Gebhart
4,406,274 A * 9/1983 Ogyn ..... 125/13.01
4,557,245 A 12/1985 Bieri
4,572,580 A 2/1986 Bieri
4,662,684 A 5/1987 Marten
4,681,145 A 7/1987 York
4,748,966 A 6/1988 Kennedy
4,832,412 A 5/1989 Bertrand
4,848,845 A 7/1989 Kennedy
4,869,227 A 9/1989 Schuldei
4,936,284 A 6/1990 Johnson
4,998,573 A 3/1991 York
5,046,890 A 9/1991 Dickson
5,129,755 A 7/1992 Dickson
5,236,278 A 8/1993 Dickson
5,378,080 A 1/1995 Dickson
5,676,125 A 10/1997 Kelly et al.
5,680,854 A 10/1997 Kingsley et al.
RE35,666 E * 11/1997 Smith ..... 125/13.01
5,690,391 A 11/1997 Kingsley et al.
5,724,956 A 3/1998 Ketterhagen
5,809,985 A 9/1998 Kingsley et al.
5,810,448 A 9/1998 Kingsley et al.
5,921,228 A 7/1999 Watson
5,950,612 A 9/1999 Zuzelo et al.
6,112,736 A 9/2000 Bearden
6,131,557 A * 10/2000 Watson ..... 125/13.01
6,253,757 B1 * 7/2001 Benson ..... 125/35

* cited by examiner

*Primary Examiner*—Eileen P. Morgan
(74) *Attorney, Agent, or Firm*—Brinks Hofer Gilson & Lione

(57) ABSTRACT

A portable concrete saw apparatus includes a motor having a rotatable shaft and a saw blade coupled to the shaft for rotation by the motor. A plate is coupled to the motor for supporting the motor. A housing surrounds the plate, motor and blade, the housing having a pair of tracks receiving opposite ends of the plate for sliding vertical movement relative to the housing. The housing includes a perimeter defining an opening in a lower side of the enclosure plane. A powered actuator is coupled between the housing and the plate for displacing the plate along the tracks between a fully retracted position wherein the blade is fully enclosed within the housing and an extended position wherein the blade projects from the housing through the opening defined by the perimeter to cut material from a work area within the perimeter and contiguous to the housing, the housing retaining the material cut by the blade from the work area. The housing can be coupled as an attachment to a skid-steer or other compact hydraulic excavator vehicle that has a source of hydraulic power. A control package permits easy operation of the vertical position of the saw within the housing, and powering of the saw motor from the vehicle.

14 Claims, 6 Drawing Sheets

PORTABLE SAW ENCLOSURE APPARATUS

BACKGROUND OF THE INVENTION

The present invention is directed to portable saws for cutting materials generally disposed in such a manner presenting a generally horizontal top surface, the saw making a generally vertical cut into the top surface to a desired depth. The invention is particularly directed to a suitable support structure permit easy handling of the portable saw while containing the material displaced by the cutting action of the saw. The present invention has particular utility in cutting concrete and rock, and in removing tree stumps. The present invention is principally directed to larger saws that are suited for manipulation by apparatus such as a compact hydraulic excavator vehicle like a skid-steer.

It is well known to employ a motor driven circular saw blade to cut a variety of materials including concrete. The circular saw blades come in a large variety of sizes and are powered by a similar variety of motor sizes. In some circumstances a protective guard is provided to partially surround the saw blade. Typically the guard is essentially semi-circular and is fixed to the motor driving the saw so that a portion of the saw blade is exposed to allow the saw to cut a given work piece. Often the guard includes a debris opening to permit the material removed from the work piece by the saw to be directed away from the saw blade in a preferred direction by a chute. Rarely, if ever, does the guard contribute to the control and stability of the apparatus. Often the guard prevents the operator from seeing or correctly assessing the position of the blade with respect to the work piece.

In some saws, protective guards are not present at all or are only of sufficient size to give the saw operator maximum visibility yet some minimum protection while maximizing the ability to employ the saw to make a variety of cuts. The reduction in size of the protective guard, or its total elimination, generally allows the debris cut from the work piece to become airborne and widely disbursed. In circumstances where there is likely to be considerable passing traffic, such as on highway construction projects, the airborne disbursement of debris is undesirable. Thus, there is a need for a saw that can be easily and safely handled for making cuts in concrete and other hard substances to permit removal thereof. There is a particular need for such a saw that would not allow the airborne distribution of debris from the work piece beyond the immediate vicinity of the saw blade.

SUMMARY OF THE INVENTION

Accordingly, the present invention includes a motor having a rotatable shaft and a saw blade coupled to the shaft for rotation by the motor. A plate is coupled to the motor, the plate having two ends. A housing surrounds the plate, motor and blade to contain any airborne debris. The housing includes a perimeter on a lower surface positionable to surround a work area. The enclosure is dimensions to be of sufficient lateral extent as to retain the material cut by the blade from the work area. An actuator is coupled to the housing and to the plate for displacing the plate between a fully retracted position wherein the blade is fully enclosed within the housing and an extended position wherein the blade projects from the housing into a work area.

Preferably, a portable saw apparatus of the present invention includes a motor having a rotatable shaft and a saw blade coupled to the shaft for rotation by the motor for sawing material from a work piece. A generally rectangular plate having two ends is coupled to the motor for supporting the motor. A generally rectangular housing encloses the plate, motor and blade. A pair of tracks are coupled to opposite interior walls of the housing to receive the ends of the plate for sliding vertical movement relative to the housing. A plurality of replaceable wear elements are coupled to a lower surface of the enclosure to define a perimeter of an opening. The wear elements are intended to endure placement in contiguous sliding contact with the work piece. A coupling is provided on an exterior surface of the housing for coupling the housing to a compact hydraulic excavator or similar vehicle. A hydraulic actuator is coupled to the housing and to the plate for displacing the plate along the tracks between a fully retracted position wherein the blade is fully enclosed within the housing and an extended position wherein the blade projects from the housing through the opening defined by the wear elements into position to cut material from the work piece area within the perimeter contiguous to said plane. The enclosure is of sufficient volume to retain the material cut by the blade from the work area thereby preventing the airborne distribution of debris beyond the perimeter of the enclosure. Hydraulic coupling elements are provided for coupling the powered actuator and the motor to a source of power on the compact hydraulic excavator vehicle controlled by an operator thereof. An indicator element is coupled to the plate and extends above the housing so as to be visible from the compact hydraulic excavator vehicle to signal the position of the blade relative to the housing.

One feature of the present invention is the housing surrounding the blade and motor, which is of sufficient interior volume to retain any airborne debris generated by operation of the saw. The feature has the advantage of significantly diminishing the spread of airborne dust, dirt and other detritus from the cutting action of the saw.

Another feature of the present invention is provision of replaceable wear elements to define a lower perimeter of the housing, the wear elements being intended to endure the sliding and scraping action that occurs when the saw is advanced along the length of a cut by the pushing action of the compact hydraulic excavator or similar vehicle.

Additional features and advantages of the present invention will become apparent to those skilled in the art from a consideration of the following description which references the accompanying drawings depicting a preferred embodiment of the present invention.

DESCRIPTION OF THE PREFERRED EMBODIMENT

Figure 1:
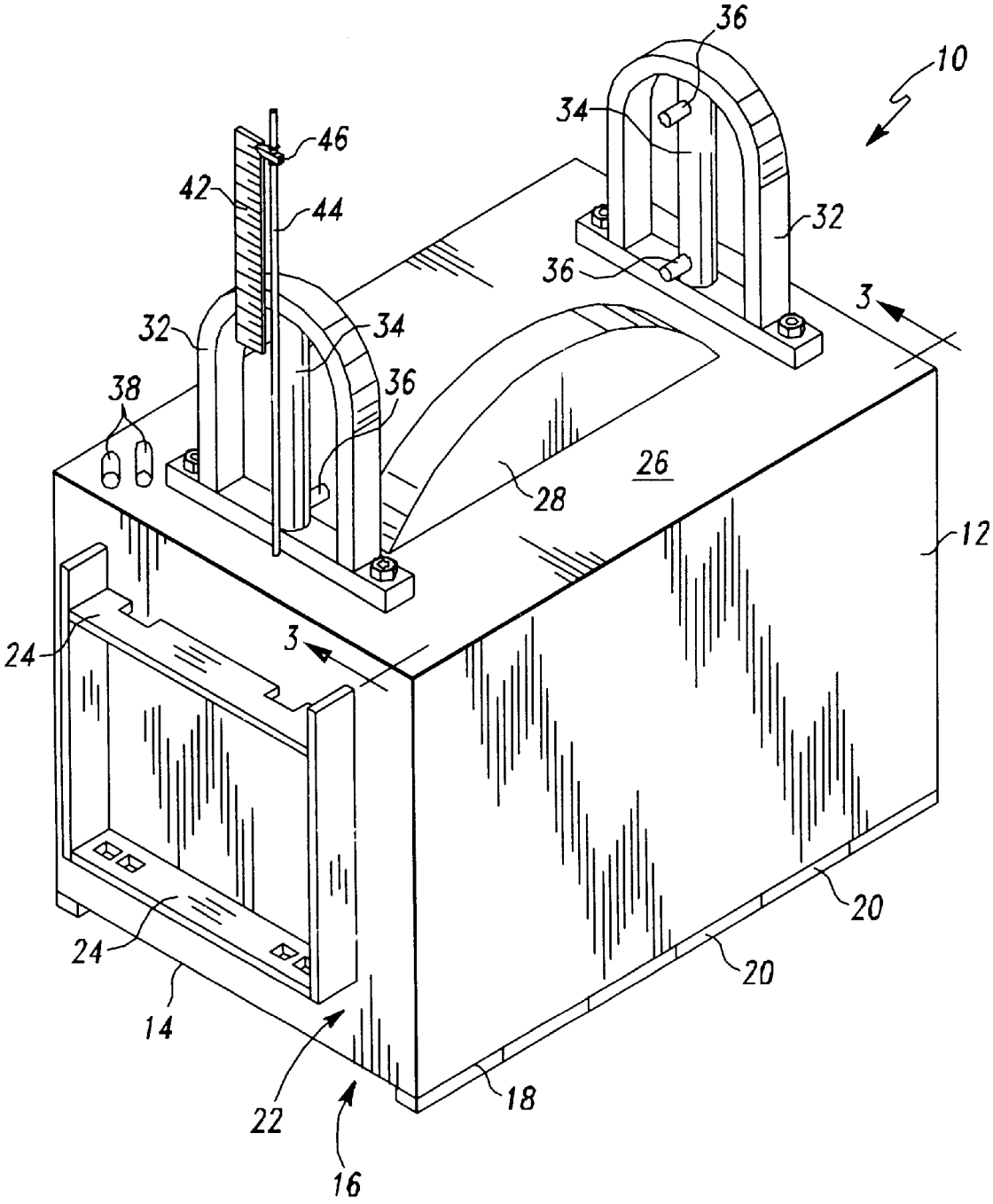
FIG. 1 is a perspective view of a portable saw apparatus of the present invention.
Figure 2:
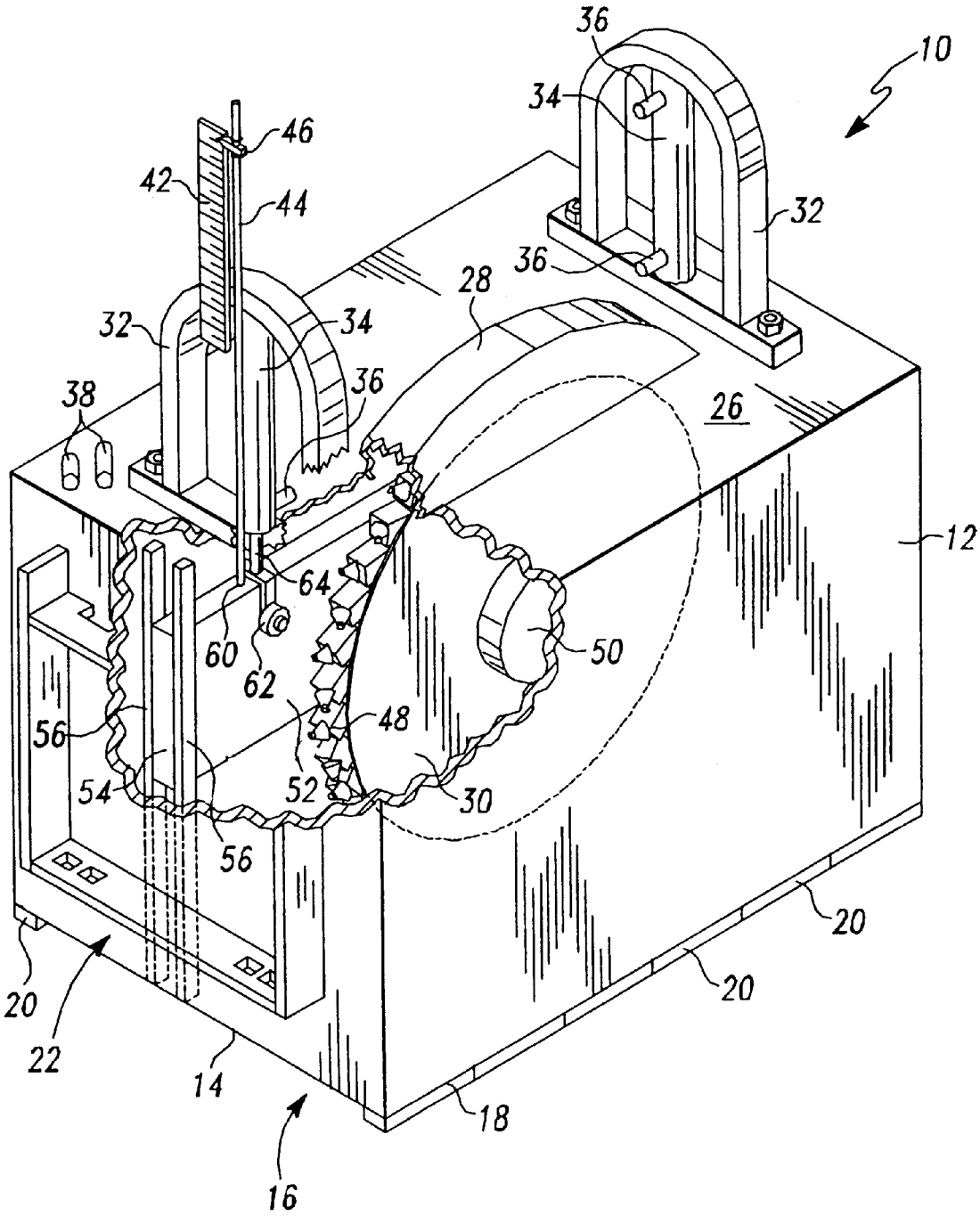
FIG. 2 is a perspective view similar to FIG. 1 partially broken away to show interior features of a portable saw apparatus of the present invention.

A portable concrete saw apparatus 10 of the present invention is shown in FIGS. 1–6. The saw apparatus 10 includes a housing 12 having a perimeter 14 on a lower side defining an opening 16. Lateral edges 18 of the perimeter 14 include replaceable wear elements 20. One end surface 22 includes brackets 24 to permit attachment of the apparatus 10 to a skid-steer or other compact hydraulic excavator vehicle 80, as shown in phantom in FIG. 6, that has a source of hydraulic power 82. A top surface 26 of the housing 10 includes a hollow arcuate chamber 28 which contains a saw blade 30 as shown in FIGS. 2–5. Hydraulic cylinder holders 32 are fixed to the top surface 26 of the housing 10, and hold hydraulic cylinders 34. Each hydraulic cylinder includes a pair of coupling elements in the form of fittings 36 adapted to be coupled to the source of hydraulic power 82 on the skid-steer or other compact hydraulic excavator vehicle 80 via appropriate controls 84. An additional pair of coupling elements in the form of fittings 38 are provided which are connected to a motor 40 coupled to the saw blade 30. The fittings 38 are also adapted to be coupled to the source of hydraulic power 82 on the skid-steer or other compact hydraulic excavator vehicle 80 via appropriate controls 84. A gage plate 42 is fixed to one of the hydraulic cylinder holders 32. A rod 44 extends through top 26 so that it can move relative to the housing 12. A pointer 46 is coupled to the rod 44 in such a manner as to point to the gage plate 42 to indicate the vertical position of the saw blade 30 within the housing 12.

The saw blade 30 consist of a disk coupled to an axle 50 having perimeteral teeth 48. The axle 50 passes through or is journaled to supporting bar 52. The supporting bar 52 includes ends 54 which are received between a set of tracks 56 which are coupled to the interior surface 58 of the housing 12 in such a manner as to permit vertical movement of the bar 52 relative to the housing 12. The lower end 60 of pointer rod 44 is coupled to the bar 52 so that any vertical movement of the bar 52 is reflected in a corresponding vertical movement of pointer rod 44. A lower end 62 of the piston rod 64 of each of the hydraulic cylinders 34 is coupled to the bar 52 so that vertical movement of the bar 52 is achieved by a corresponding movement of the piston rods 64 within the cylinders 34. The movement of the piston rods 64 is in response to changes in the hydraulic pressure in the cylinders 34 achieved through variations in the hydraulic fluid fed to couplings 36.

Figure 3:
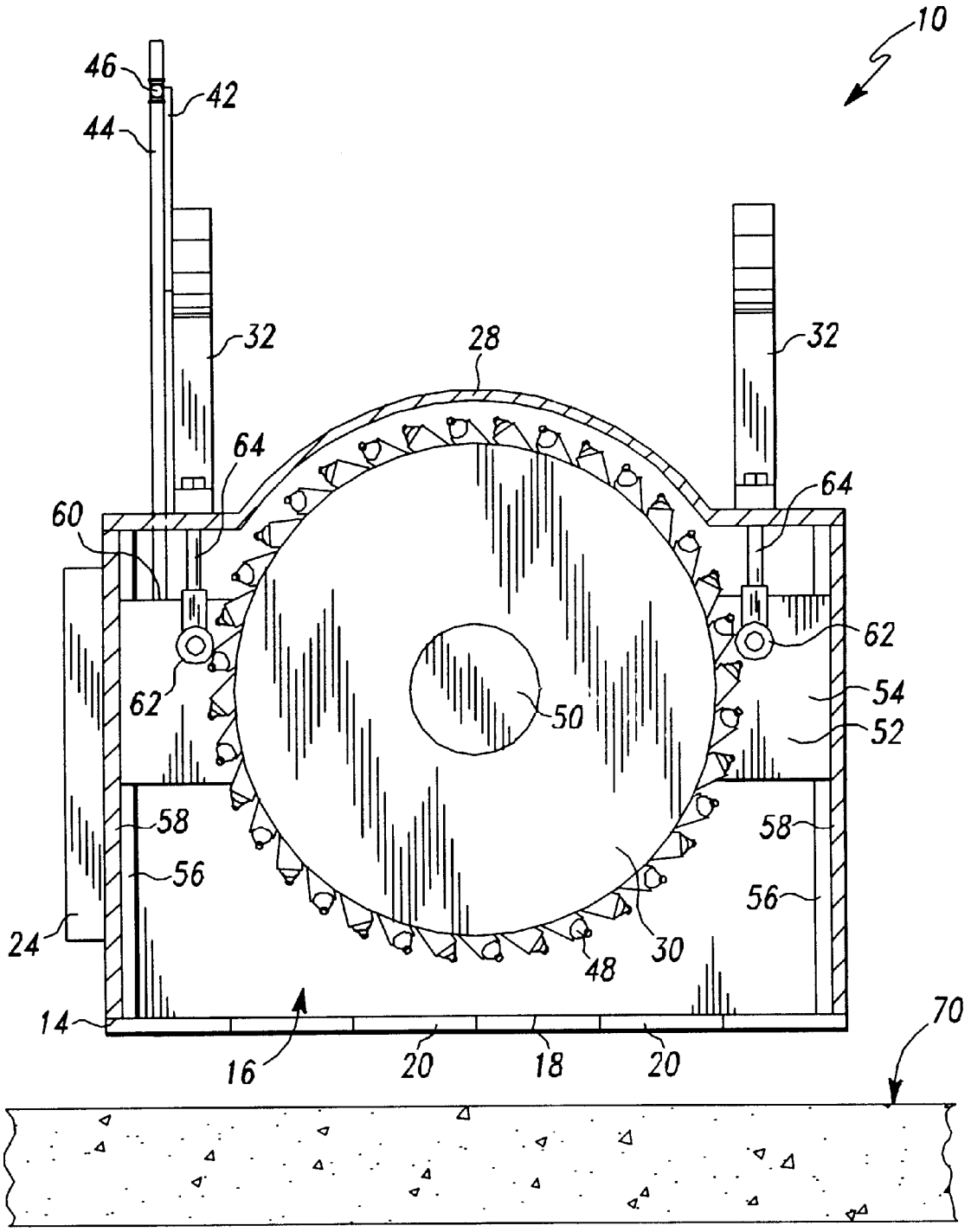
FIG. 3 is a sectional view of the portable saw apparatus shown in FIG. 1, taken along section line 3—3 with the blade situated in a fully retracted position.
Figure 4:
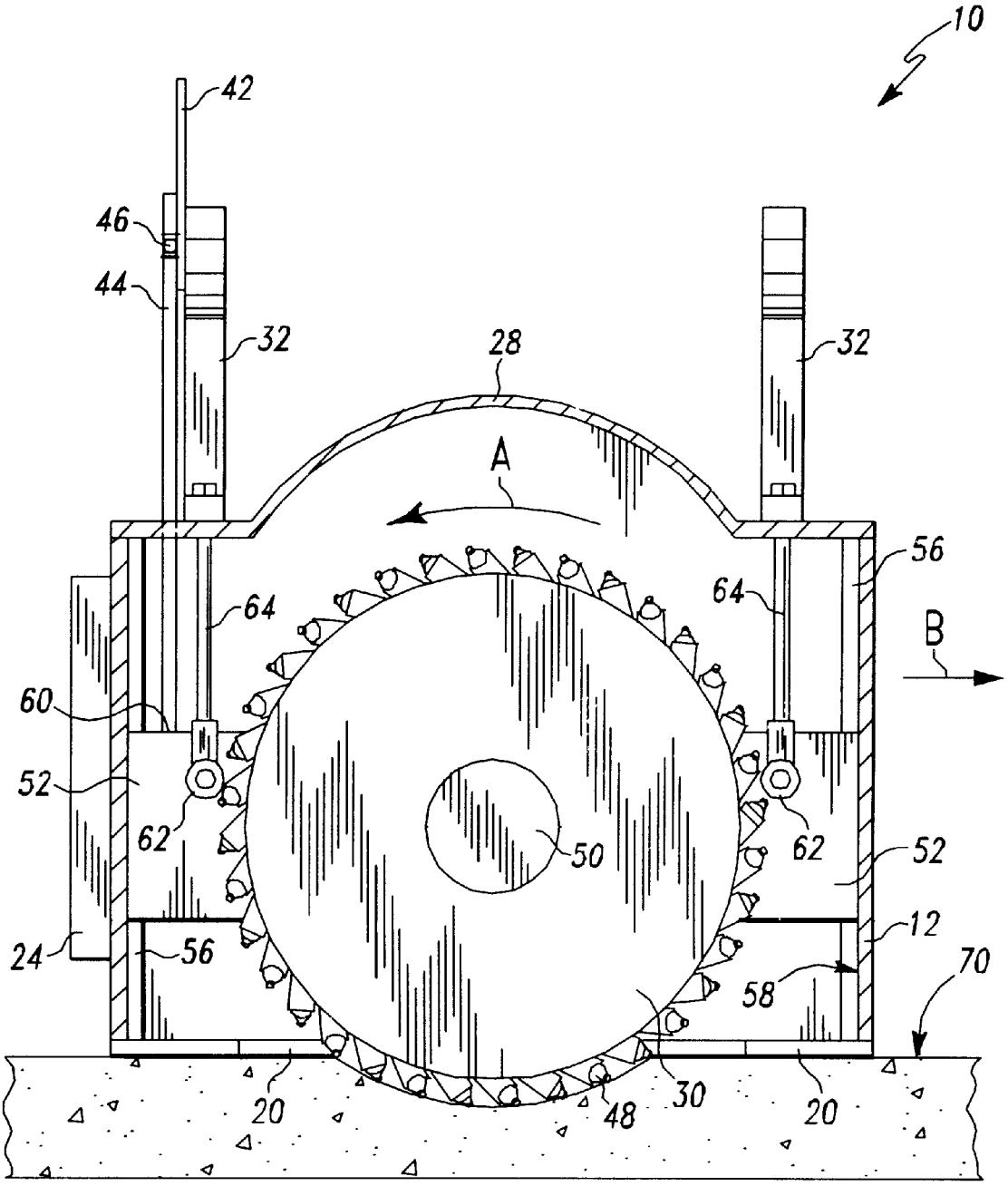
FIG. 4 is a sectional view similar to FIG. 3 with the blade situated in an extended position.
Figure 5:
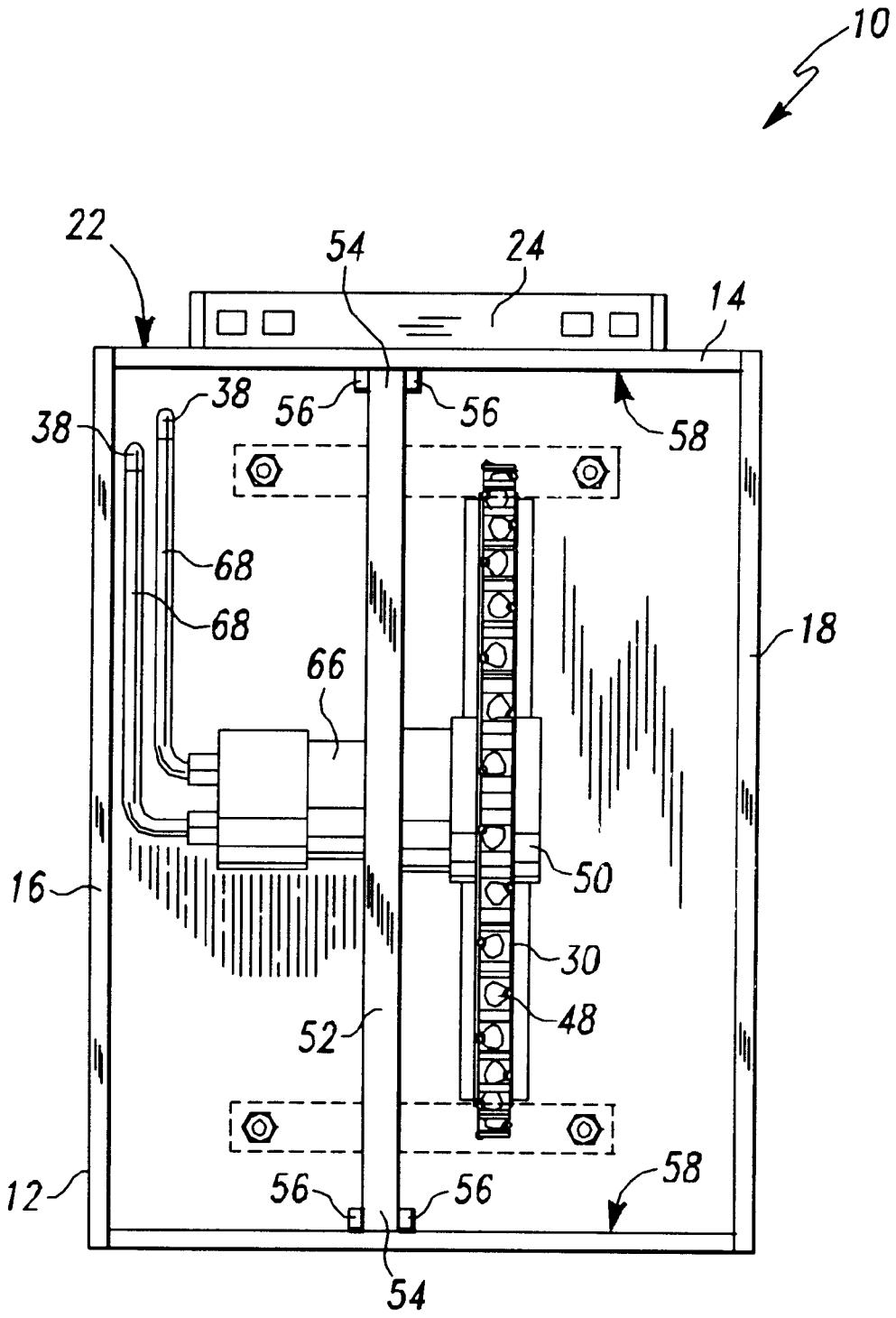
FIG. 5 is a bottom plan view of the portable saw apparatus shown in the prior FIGS.

The saw blade 30 can be rotated with the rotation of axle 50 by hydraulic motor 66 shown in FIG. 5. The hydraulic motor 66 is coupled to couplings 38 by connecting hoses 68 which are sufficiently long and flexible as to permit the required vertical movement of bar 52 within housing 12. The vertical movement itself is shown in FIGS. 3 and 4. The saw apparatus 10 is shown in FIG. 3 suspended above a substrate surface 70 such as a road. Also in FIG. 3, the blade 30 and supporting bar 50 are shown near or at the uppermost position within the housing 12. In this position the blade 30 does not project through the surface defined by the lower perimeter 14 of the housing 12, and the upper most portion of the blade 30 is received in the hollow arcuate portion 28 of the housing 12. The pointer 46 is also positioned near the top of scale 42. The saw apparatus 10 is shown in FIG. 4 with the replaceable wear surfaces 20 in contact with the substrate surface 70. Also in FIG. 4, the blade 30 and supporting bar 50 are shown in a lowered position relative to the housing 12. In the illustrated lowered position, a lower portion of the blade 30 extends through the plane defined by the lower perimeter 14 of the housing 12, and the upper most portion of the blade 30 is no longer received in the hollow arcuate portion 28 of the housing 12. The pointer 46 is also positioned near the middle of scale 42.

Figure 6:
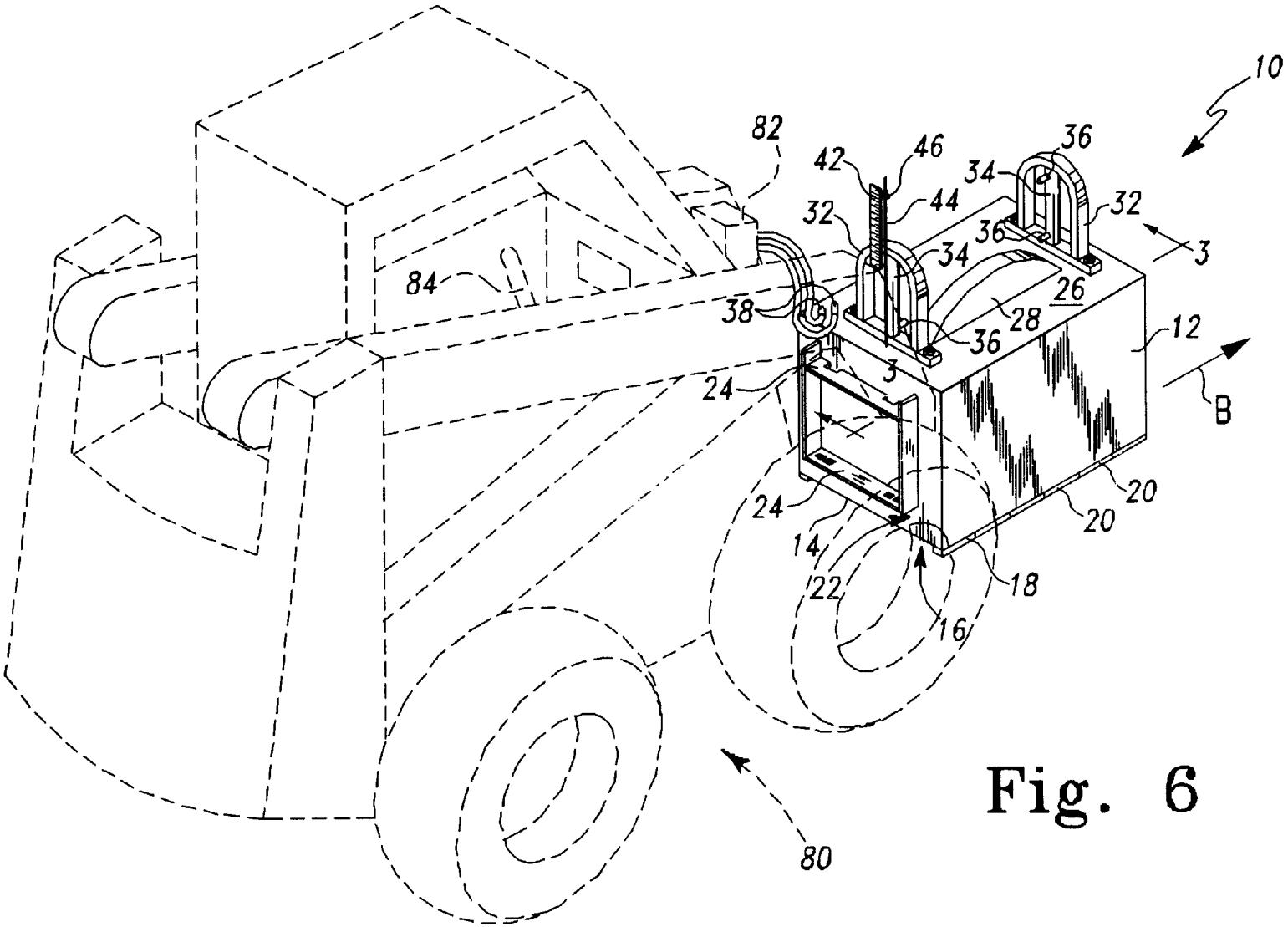
FIG. 6 is a perspective view of a portable saw apparatus of the present invention coupled to a compact excavator vehicle.

Most importantly, the blade 30 is shown extending downward into a kerf that has been cut into the substrate surface 70 by virtue of the rotation of the blade 30 in the direction of arrow A. It will be appreciated that the entire apparatus 10 including the enclosure 12 can be slid forward, in the direction of arrow B, by the skid-steer or other compact hydraulic excavator vehicle 80 coupled to the brackets 24 as shown in FIG. 6. This forward motion causes the blade 30 to cut a linear trench at a depth indicated by the pointer 46 relative to the scale 42, which is visible to the operator of the skid-steer or other compact hydraulic excavator vehicle 80. Further, the material cut from the kerf is retained by the enclosure 12 so that rock, dust and other debris is not broadcast to the surrounding area, thereby significantly reducing, if not eliminating the detrimental features of such a cutting operation.

While the invention has been described in relation to the illustrated preferred embodiment, other embodiments may become apparent to those skilled in the art which are within the spirit of the invention and are intended to be encompassed by the following claims.

What is claimed is:

1. In an apparatus including a motor having a rotatable shaft and a saw blade coupled to the shaft for rotation by the motor, the improvement comprising:

a plate coupled to the motor, the plate having two ends, a housing surrounding the plate, motor and blade, the housing including a perimeter on a lower surface defining a work area below the housing, the housing being of sufficient lateral extent as to retain all material cut by the blade from the work area, and a powered actuator coupled to the housing and to the plate for displacing the plate between a fully retracted position wherein the blade is fully enclosed within the housing and an extended position wherein the blade projects from the housing into the work area.

2. The improvement of claim 1 further comprising a set of tracks coupled to an interior surface of the housing, the set of tracks receiving an end of the plate for sliding movement relative to the housing.

3. The improvement of claim 1 further comprising an indicator element coupled to the plate and extending above the housing to signal the position of the blade relative to the housing.

4. The improvement of claim 1 wherein the powered actuator comprises a pair of hydraulic cylinders, each cylinder coupled between the housing and one end of the plate, the pair of cylinders being coupled on opposite ends of the plate.

5. The improvement of claim 1 further comprising a coupling fixed to the outside of the housing for engaging a compact hydraulic excavator vehicle.

6. The improvement of claim 1 wherein the perimeter on the lower surface of the housing comprises a plurality of replaceable wear elements.

7. The improvement of claim 1 wherein the saw blade comprises a disk having a plurality of tooth-receiving elements situated around the perimeter of the disk, each tooth-receiving element receiving a replaceable tooth.

8. In a portable saw apparatus including a motor having a rotatable shaft and a saw blade coupled to the shaft for rotation by the motor for sawing material from a work piece, the improvement comprising: a plate coupled to the motor for supporting the motor, the plate having two ends, a housing enclosing the plate, motor and blade, the housing having a pair of tracks receiving the ends of the plate for sliding vertical movement relative to the housing, the enclosure including a perimeter defining an opening in a plane, the saw apparatus being movable so that the perimeter is in contiguous contact with the work piece, a powered actuator coupled to the housing and to the plate for displacing the plate along the tracks between a fully retracted position wherein the blade is fully enclosed within the housing and an extended position wherein the blade projects from the housing through the opening defined by the perimeter to cut material from the work piece within the perimeter contiguous to said plane, the enclosure being of sufficient volume to retain the material cut by the blade from the work piece.

9. The improvement of claim 8 wherein the plate comprises a generally rectangular support coupled to the motor, the plate including an opening receiving the rotatable shaft of the motor.

10. The improvement of claim 8 wherein the housing includes a coupling on an exterior surface thereof for coupling the housing to a compact hydraulic excavator vehicle.

11. The improvement of claim 10 further comprising hydraulic coupling elements for coupling the powered actuator to a source of power on the compact hydraulic excavator vehicle.

12. The improvement of claim 8 wherein the powered actuator comprises a pair of hydraulic cylinders coupled to the housing including pistons coupled to opposite ends of the plate to move the plate vertically relative to the housing.

13. The improvement of claim 8 further comprising an indicator element coupled to the plate and extending above the housing to signal the position of the blade relative to the housing.

14. In a portable saw apparatus including a motor having a rotatable shaft and a saw blade coupled to the shaft for rotation by the motor for sawing material from a work piece, the improvement comprising: a generally rectangular plate coupled to the motor for supporting the motor, the plate having two ends, a generally rectangular housing enclosing the plate, motor and blade, a pair of tracks coupled to opposite interior walls of the housing and receiving the ends of the plate for sliding vertical movement relative to the housing, a plurality of replaceable wear elements coupled to a lower surface of the enclosure defining a perimeter of an opening for placement in contiguous contact with the work piece, a coupling on an exterior surface thereof for coupling the housing to a compact hydraulic excavator vehicle, a hydraulic actuator coupled to the housing and to the plate for displacing the plate along the tracks between a fully retracted position wherein the blade is fully enclosed within the housing and an extended position wherein the blade projects from the housing through the opening defined by the wear elements into position to cut material from the work piece within the perimeter contiguous to said plane, the enclosure being of sufficient volume to retain the material cut by the blade from the work piece, hydraulic coupling elements for coupling the powered actuator and the motor to a source of power on the compact hydraulic excavator vehicle, and an indicator element coupled to the plate and extending above the housing to signal the position of the blade relative to the housing.

* * * * *